United States Patent [19]

Focke et al.

[11] Patent Number: 5,056,536

[45] Date of Patent: Oct. 15, 1991

[54] PROCESS AND APPARATUS FOR TESTING CIGARETTES

[75] Inventors: Heinz Focke; Jürgen Focke, both of Verden, Fed. Rep. of Germany

[73] Assignee: Focke & Co. (GmbH & Co.), Verden, Fed. Rep. of Germany

[21] Appl. No.: 263,943

[22] Filed: Oct. 28, 1988

[30] Foreign Application Priority Data

Nov. 16, 1987 [DE] Fed. Rep. of Germany ..... 3738820

[51] Int. Cl.[5] ..... A24C 5/60

[52] U.S. Cl. ..... 131/283; 131/283

[58] Field of Search ..... 131/280, 905, 906, 281

[56] References Cited

FOREIGN PATENT DOCUMENTS 1929721 12/1969 Fed. Rep. of Germany .

2527547 12/1983 France .

*Primary Examiner*—V. Millin

*Attorney, Agent, or Firm*—Sughrue, Mion, Zinn, Macpeak & Seas

[57] ABSTRACT

When testing the cigarettes (10, 11) of cigarette groups (16, 17) in pockets (13, 14) of a conveyor, particularly a cigarette turret (12), difficulties relating to adequate spacing of the testing members (29 . . . 32) from one another arise when the cigarettes (10, 11) have an especially small diameter. In order to make undisturbed testing by means of moving the testing members (29 . . . 32) near to the end faces of the cigarettes (10, 11) nevertheless possible, these are tested successively in several, especially two steps, whereby during these testing cycles cigarettes, spaced a somewhat greater distance apart from one another in each case, are acted upon by the testing members (29 . . . 32). Particularly within cigarette rows (18 . . . 21) only every other cigarette is tested in each case.

9 Claims, 4 Drawing Sheets

PROCESS AND APPARATUS FOR TESTING CIGARETTES

BACKGROUND OF THE INVENTION

The invention relates to a process for testing cigarettes of a cigarette group corresponding particularly to the contents of a cigarette pack, whereby testing members assigned to each cigarette of a cigarette group are moved near to the end faces of the cigarettes. Furthermore, the invention relates to an apparatus for testing cigarettes.

Testing of the cigarettes is effected in connection with packaging of the same. The cigarettes are tested for a correct and adequate tobacco filling and for the presence and correct formation of a filter in as far as filter cigarettes are concerned.

For this purpose, testing members of a testing unit are conveyed near to the end faces of the cigarettes. The testing members can be constructed in various ways. Frequently spring-loaded testing rams, movable in an axial direction, are used, similar to the embodiment according to DE-PS 22 29 382. Optoelectronically operated sensors are also known and suitable. Several of this type of testing member are combined by a holding device to form a testing unit. When a defective cigarette is discovered, the entire cigarette group is usually seperated out from the packaging process.

SUMMARY OF THE INVENTION

The objective of the invention is to further develop the cigarette-testing process named at the outset in such a manner that in the case of high performance, i.e. short working or conveying cycles, great accuracy in the testing of cigarettes is attained, especially of cigarettes with a small diameter in a compact arrangement.

To achieve this objective the process according to invention is characterized in that the cigarettes of one cigarette group are tested in several, especially two, successive testing cycles, whereby cigarettes, spaced apart from one another in each case, are tested simultaneously during a testing cycle.

Thus, in the process according to invention the entire cigarette group is not tested simultaneously by a number of testing members equivalent to the number of cigarettes, but rather only a part of the cigarettes of a cigarette group are tested. The entire cigarette group then is tested in several, supplementary testing cycles.

The selection of the cigarettes to be grasped per testing cycle is effected in accordance with a spatially optimum arrangement of the testing members of a testing unit. Thus, these can be so constructed and, in particular, disposed such a distance apart from one another that a reciprocal interference or influence during the testing cycle cannot occur.

When the cigarettes of a cigarette group are arranged in rows (longitudinal rows and possibly cross rows) the testing members are so disposed that in each testing cycle only every other cigarette is tested. Then in the next testing cycle the cigarettes omitted before are tested.

The apparatus for testing cigarettes is so equipped, namely with testing members, that the distance said testing members are spaced apart from one another is equivalent to the distance between two cigarettes. When testing in two testing cycles each testing unit has half of the testing members required in total. Said testing members are arranged in rows in such a manner that every other cigarette is acted upon by a testing member.

According to a further feature of the invention several, in particular two testing units, are disposed on both sides of the cigarette groups, i.e. the moving track of the same, for testing both ends of the cigarettes. During a stoppage phase of the cyclically conveyed cigarette groups the testing units are delivered to said cigarette groups. Thus during a testing cycle, subgroups of two cigarette groups are tested simultaneously so that after each conveying cycle a cigarette group is completely tested.

BRIEF DESCRIPTION OF THE DRAWINGS

Further features of the invention concern the construction of the testing units, their support and operation.

An embodiment of the invention is explained in more detail below on the basis of the drawings. In these.

DETAILED DESCRIPTION OF THE PREFERRED EMBODIMENT

Figure 1:
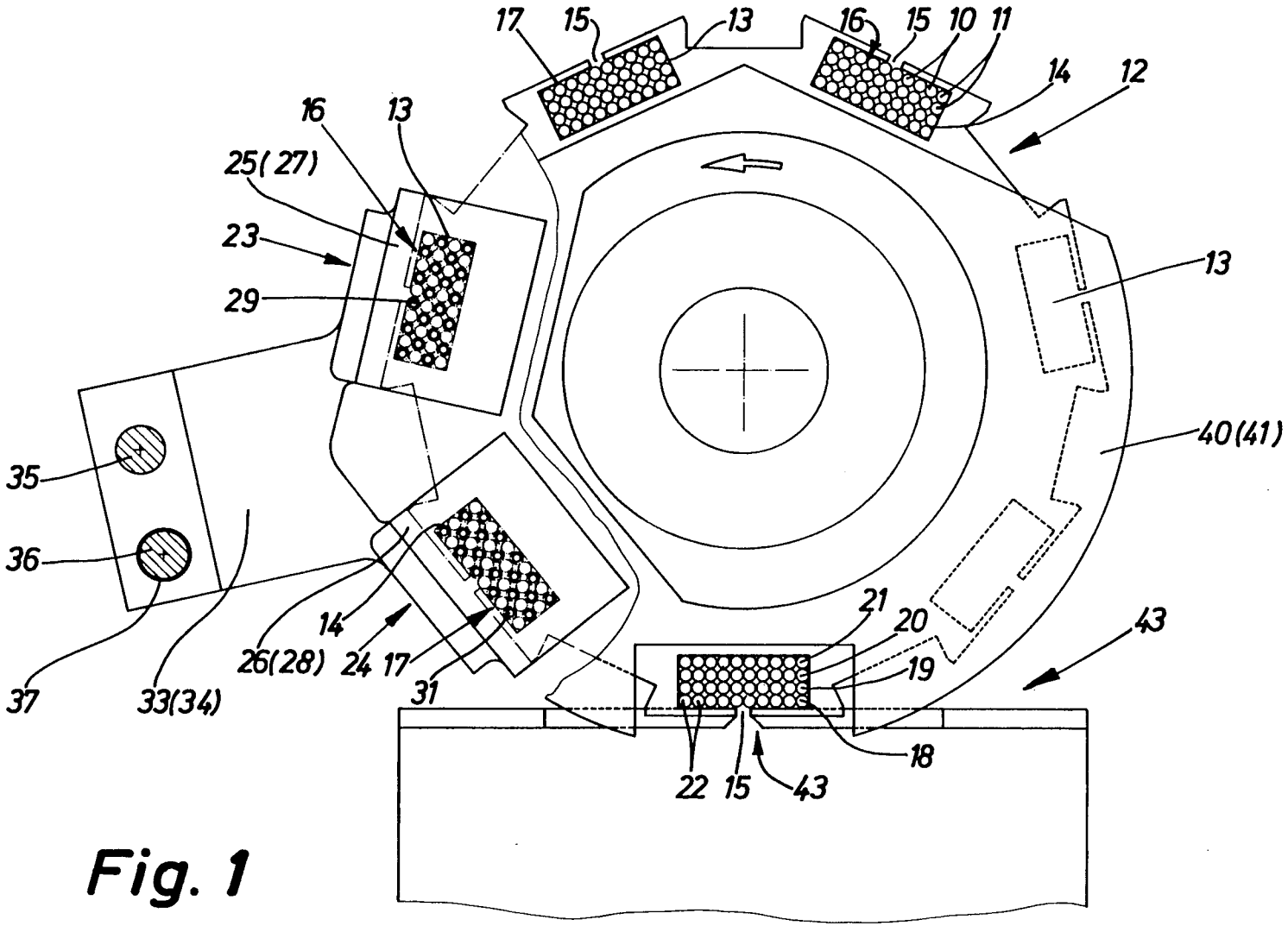
FIG. 1 shows a diagrammatic side view of a conveyor for cigarette groups, namely a cigarette turret.

The testing of cigarettes 10, 11 takes place in connection with packaging of the same. The apparatus shown as embodiment is composed of a cigarette turret 12 which usually is cyclically rotatable in connection with a cigarette magazine of a packaging machine in a vertical plane. Along its periphery the cigarette turret 12 is provided with a plurality of pockets 13, 14. These pockets are open at their axial faces. A radially external pocket wall 14 is provided with an aperture 15, directed longitudinally, for passage of the conveying member.

The cigarettes 10, 11 are extracted from the cigarette magazine (not represented) in the usual way by means of pushing devices and after formation of a cigarette group 16, 17 in each case, are fed in longitudinal direction to a cigarette turret 12, namely to a pocket 13 or 14 disposed in the upper region. In the present example the two upper transversal pockets 13, 14 are each filled with a cigarette group 16, 17 at the same time, for reasons of expediency. Then the cigarette turret 12 is advanced a distance equivalent to a pocket 13, 14.

The cigarette groups 16, 17 are usually composed of several rows 18, 19, 20, 21. Within these rows 18..21 the cigarettes are densely packed. The arrangement can be made such that the cigarettes of adjacent rows are disposed offset to one another (saddle position). In the present embodiment, however, each cigarette group 16, 17 consists of the relatively large number of forty cigarettes 10, 11. Thus each row 18..21 consists of ten cigarettes 10, 11. The arrangement is made in such a manner that cross rows 22 of four cigarettes each are formed.

As shown in FIG. 1, the cigarette groups 16, 17 formed thusly, first reach a first testing station 23 and then a second testing station 24 by means of rotation of the cigarette turret 12. Each testing station is equipped with at least one testing unit 25, 26. In the present embodiment both exposed ends of the cigarettes 10, 11 are tested; therefore additional testing units 27, 28 are disposed on the opposite side of the cigarette turret 12.

Figure 2:
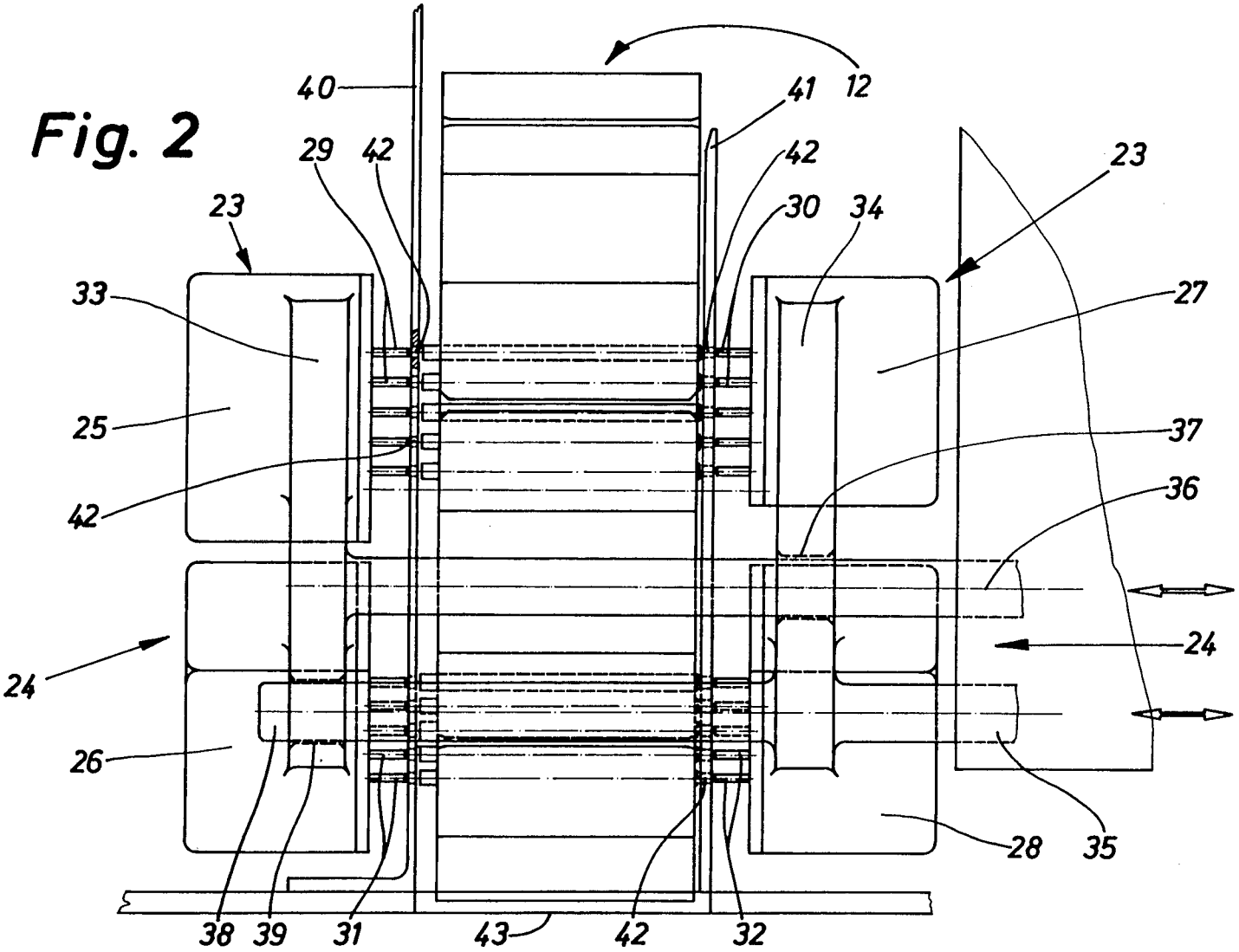
FIG. 2 shows a front view of the cigarette turret according to FIG. 1.

During a testing cycle it is the task of each testing unit 25..28 to test a designated number of cigarettes for correct formation. For this purpose the testing units 25..28 are equipped with testing members 29, 30, 31. As shown in FIG. 2 these testing members 29..32 are constructed as relatively thin, axially movable rams. These rams are spring-loaded. To carry out the testing of cigarettes 10, 11 the testing units 25..28 are moved near to the respective cigarette group 16, 17 in such a manner that the end faces of the cigarettes 10, 11 are acted upon by the testing members 29..32. A certain pressure is exerted such that in the case of properly formed cigarettes the testing members (rams) are displaced in the testing unit 25..28. In the case of defective cigarettes only slight axial displacement of the respective testing member or none at all occurs. This triggers an error signal in a suitable manner.

Figure 3:
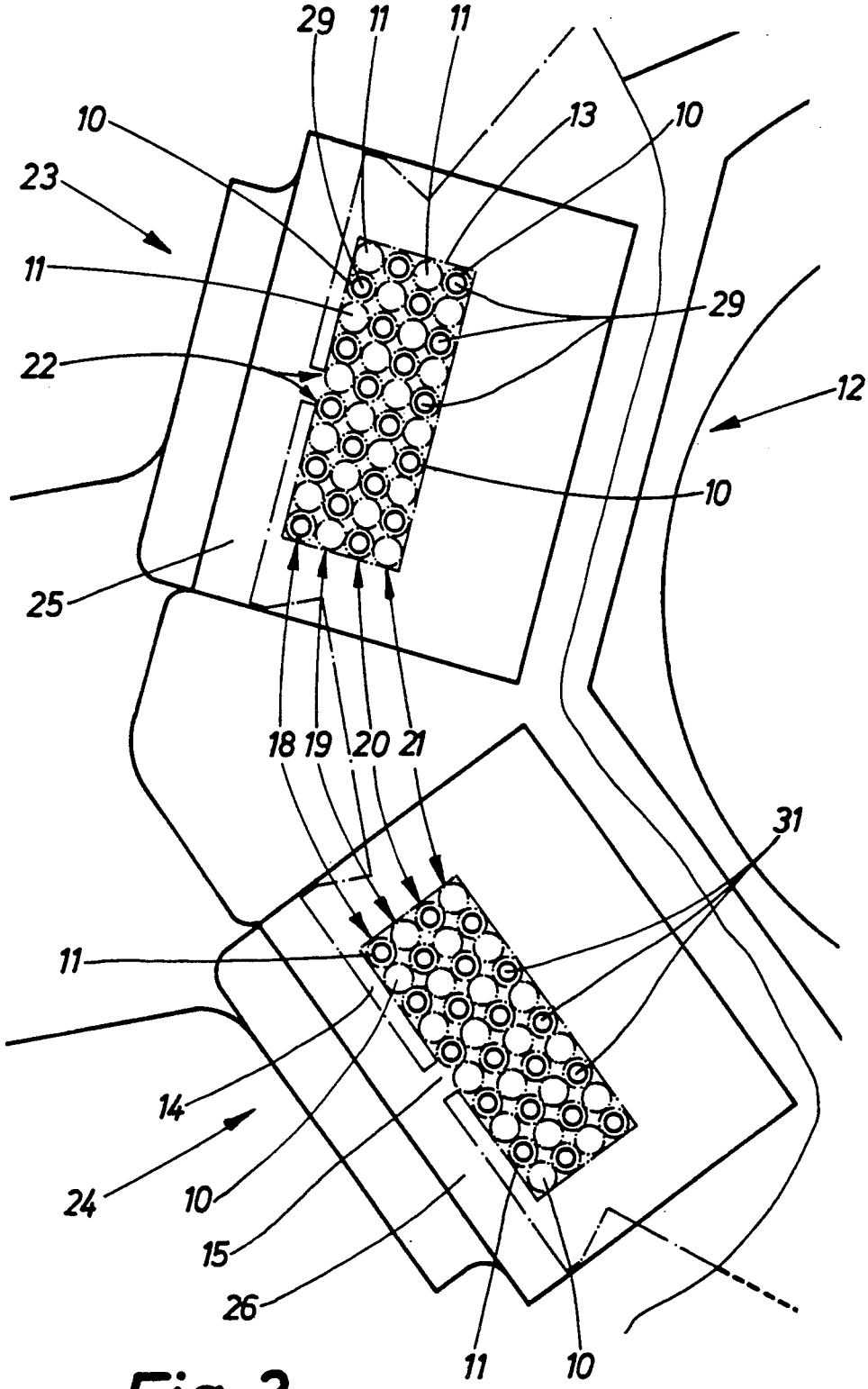
FIG. 3 shows a detail of the cigarette turret in a representation according to FIG. 1 on an enlarged scale.

The number of testing members 29..32 per testing unit 25..28 is less than the total number of cigarettes 10, 11 per cigarette group 16, 17. In the embodiment shown, having two testing units 25, 26 and/or 27, 28 disposed on each side of the cigarette group 16, 17 the entire cigarette group 16, 17 is tested in two cycles. In the first testing station 23 the appropriately marked cigarettes 10 shown in FIG. 3 are tested. The arrangement of testing members 29 of the testing unit 25 is so selected that every other cigarette 10 within the rows 18..21 are tested. The testing members 29 of an adjacent row are staggered. Thus in this embodiment it is possible to distribute testing members 29..32 equivalent in number to half of the cigarettes 10, 11 of a cigarette group 16, 17 in such a manner that said testing members are spaced a maximum distance apart from one another. When testing the same cigarette group in the testing station 24—after a conveying cycle of the cigarette turret 12—the cigarettes 11 omitted in the previous testing station 23 are tested by means of an appropriately staggered arrangement of the testing members 31. Here too, the testing members 31 are spaced the same maximum distance apart from one another. In both cases the testing members 29, 31 are distributed in a regular formation.

Testing units 27 and 28, opposite to testing units 25, 26, are constructed in the same way and equipped with testing members 30, 32. The testing members 30 of the testing unit 27 are directed the same axially as the testing members 29 on the opposite side. As a result of simultaneous delivery of all testing units 25..28 the respective testing members act upon the same cigarettes 10, 11.

The four testing units 25..28, employed in the embodiment shown, are operated together simultaneously. For this purpose the testing units 25 and 26, disposed on one side of the cigarette turret 12, and 27 and 28 on the other side, respectively, are connected with one another, in the present case by means of a traverse 33, 34. Operating rods 35, 36, movable back and forth, are each attached to said units (see FIGS. 1 and 2). Drive of the same is effected from one side of the cigarette turret 12. For this purpose, the traverse 33, situated on the opposite side of the cigarette turret 12, is connected to an operating rod 36 which is directed laterally past the cigarette turret 12. This operting rod 36 is passed through a guide hole 37 in the traverse 34. The guide hole 37 forms a slideway for the operating rod 36. The other operating rod 35 is lengthened as far as the region of the opposite tranverse 33 by means of a guide rod 38 and, here too, is led into a guide hole 39. Through this mutual bracing and support of the operating rods 35, 36 in and/or on the traverses 33 and 34, tilt-free motion of the testing units 25..28 is ensured at the same time.

The ends of the cigarettes 10, 11 project slightly out of the pockets 13, 14. A stationary limiting disk 40, 41 is disposed on both sides, respectively, of the cigarette turret 12, at a slight distance from the ends of the cigarettes 10, 11 (see FIGS. 1 and 2). In the region of the testing stations 23, 24 the limiting disks 40, 41 are provided with bores 42 which are coordinated with the testing members 29..32 as to size and spatial arrangement in such a manner that said testing members can pass through the bores in order to carry out the testing of the cigarettes. The testing units 25..28 with their testing members 29..32 are pulled back to the outside of the limiting disks 40, 41 during a rotating cycle of the cigarette turret 12.

By means of the cigarette turret 12 the tested cigarette groups 16, 17 are fed to carry-off track 43, extending horizontally below said turret. In familiar fashion, this track is provided with a revolving conveyor (not shown), the carriers of which are conveyed through the pockets 13, 14 in longitudinal direction while taking along the cigarette groups 16, 17.

Figure 4:
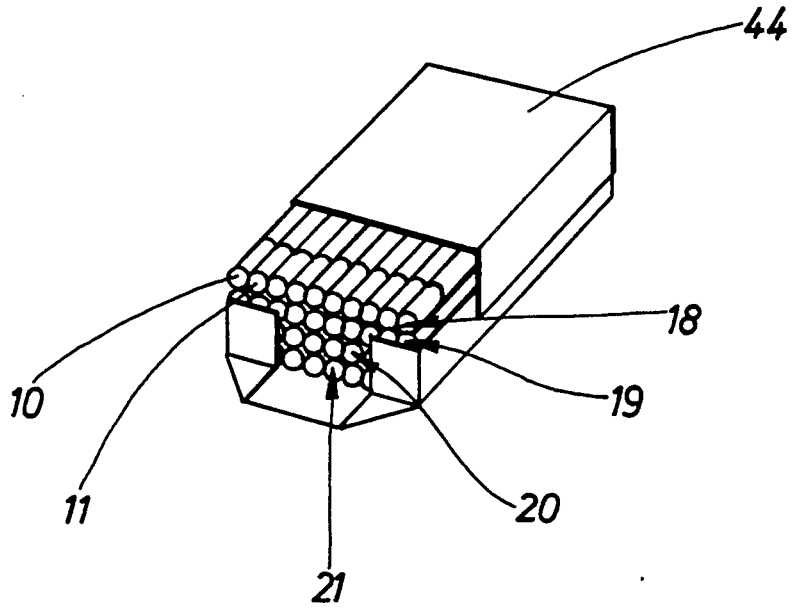
FIG. 4 shows a representation in perspective of a partially wrapped cigarette group.

The test apparatus described is especially suited for testing cigarettes with extremely small diameter of e.g. 5.7 mm. FIG. 4 shows a cigarette group 16, 17 composed of such cigarettes 10, 11 with an inner wrapper 44 made of tin foil, or the like. A cigarette pack composed of these thin cigarettes 10, 11 here contains forty cigarettes which are arranged in rows 18..21 in the manner described. Inspite of the small diameter of the cigarettes the testing members 29..32 can be constructed in an adequate way and can operate without reciprocal impairment. The described arrangement of the testing members 29..32 makes adequate spacing of the same from one another possible.

We claim:

1. Process for testing cigarettes of a cigarette group corresponding to the contents of a cigarette pack, whereby testing members assigned to each cigarette of a cigarette group are moved near to the end faces of each of the cigarettes, characterized in that the cigarettes (10, 11) of a cigarette group (16, 17) are tested in two successive testing cycles, whereby cigarettes lying spaced apart from one another are tested simultaneously during one testing cycle.

2. Process according to claim 1, characterized in that every other cigarette of the cigarettes (10, 11) of a cigarette group (16, 17), lying in rows (18, 19, 20, 21), is tested.

3. Process according to claim 1 or 2, characterized in that the cigarettes (10, 11) are tested at both end faces, of the same cigarettes (10, 11) of a cigarette group (16, 17) simultaneously.

4. Apparatus for testing cigarettes of a cigarette group corresponding to the contents of a cigarette pack, having two testing units (25, 26; 27, 28) with testing members (29, 30, 31, 32) which are moved successively near to the cigarettes (10, 11) of the same cigarette group (16, 17) for testing, whereby the testing members (29, 30) of an initial testing unit (25, 27) are assigned to an adequate number of cigarettes (10) and testing members (31, 32) of at least one other testing unit (26, 28) are assigned to the remaining cigarettes (11) of the same cigarette group (17), characterized in that, when the cigarettes (10, 11) are arranged in several rows (18, 19, 20, 21), the testing members (29..32) of the testing units (25, 26; 27, 28) also arranged in rows are spaced apart from one another by a distance equivalent to two cigarettes (10, 11) such that every other cigarette in a row is grasped by the testing members (29..32) of a testing unit (25..28) and the testing members of several rows are disposed offset relative to one another.

5. Apparatus according to claim 4, characterized in that the cigarette groups (16, 17) are transported in pockets (13, 14) of a cigarette conveyor, in the form of a cyclically rotatable cigarette turret (12), whereby in successive testing stations (23, 24) the testing units (25..28) are moved near to the cigarette groups (16, 17) during stoppage of the cigarette turret (12).

6. Apparatus according to claim 5 characterized in that testing units (25..28) in the testing stations (23, 24) are disposed on both sides of the cigarette turret (12) and the testing members of which are delivered to both end faces of the cigarettes in such a manner that the cigarettes to be tested are tested at both ends simultaneously.

7. Apparatus according to claim 6, characterized in that the testing units (25, 26; 27, 28) disposed on the same side of the cigarette turret (12) are connected to one another, by traverses (33, 34) and are movable by means of a common actuating member (35, 36).

8. Apparatus according to claim 7, characterized in that the testing units (25, 26; 27, 28) on both sides of the cigarette turret (12) are operated from the same side by means of operating rods (35, 36), movable back and forth, which are glide supported, directly or via a guide rod (38), in one of two said traverses (33, 34) or in a guide hole (37, 39) of the same.

9. Apparatus according to claim 5, characterized in that stationary limiting disks (40, 41) disposed on both sides of the cigarette turret (12) in the region of the testing units (25..28) are provided with bores (42) for passage of the testing members (29..32).

* * * * *